US008576135B1

(12) United States Patent
Krivokapic

(10) Patent No.: US 8,576,135 B1
(45) Date of Patent: Nov. 5, 2013

(54) BICONE ANTENNA

(75) Inventor: Ivan Krivokapic, San Diego, CA (US)

(73) Assignee: Olympus Corporation, Tokyo (JP)

( * ) Notice: Subject to any disclaimer, the term of this patent is extended or adjusted under 35 U.S.C. 154(b) by 162 days.

(21) Appl. No.: 13/016,863

(22) Filed: Jan. 28, 2011

(51) Int. Cl.
*H01Q 13/00* (2006.01)

(52) U.S. Cl.
USPC ..... 343/773; 343/807

(58) Field of Classification Search
USPC ..... 343/807, 772, 773, 774
See application file for complete search history.

(56) References Cited

U.S. PATENT DOCUMENTS

| | | | | |
|---|---|---|---|---|
| 3,942,180 | A * | 3/1976 | Rannou et al. | 343/725 |
| 6,972,726 | B2 * | 12/2005 | Sato et al. | 343/725 |
| 7,221,326 | B2 * | 5/2007 | Ida et al. | 343/773 |
| 7,330,157 | B2 * | 2/2008 | Sugawara et al. | 343/750 |
| 2005/0093756 | A1 * | 5/2005 | Martek | 343/773 |

* cited by examiner

*Primary Examiner* — Hoanganh Le
(74) *Attorney, Agent, or Firm* — Sheppard Mullin Richter & Hampton LLP

(57) ABSTRACT

A bicone antenna is provided with high bandwidth and beneficial return loss performance. The antenna is dipole based and thus its radiation pattern is not strongly influenced by shape and size of a nearby ground plane. A parasitic element comprising a conductive band encircling the antenna's feed structure improves matching, gain flatness, and makes the antenna less susceptible to detuning.

18 Claims, 13 Drawing Sheets

BICONE ANTENNA

TECHNICAL FIELD

The present invention relates generally to omnidirectional antennas, and more particularly, some embodiments relate to wideband omnidirectional antennas for mobile communications.

DESCRIPTION OF THE RELATED ART

Recently, wideband communications technologies have gained attention for short-range high data rate applications. For example, the Ultra-Wideband (UWB) spectrum from 3.1 to 10.6 GHz has been allocated for low spectral density wideband transmission by the FCC. FIG. 1 illustrates the regulatory status as of January, 2009 for UWB communication spectrum in a variety of countries. In handheld applications, small antenna size is desirable. However, commercially available wideband antennas, although small in size, typically require large ground planes and exhibit poor radiation pattern and gain properties. Particularly, many antennas exhibit poor performance when in proximity to human tissue.

BRIEF SUMMARY OF EMBODIMENTS OF THE INVENTION

In various embodiments of the invention, a bicone antenna is provided with high bandwidth and beneficial return loss performance. The antenna is dipole based and thus its radiation pattern is not strongly influenced by shape and size of a nearby ground plane. A parasitic element comprising a conductive band encircling the antenna's feed structure improves matching, gain flatness, and makes the antenna less susceptible to detuning.

According to an embodiment of the invention, a bicone antenna, comprises a dielectric body having an upper portion, a lower portion, and a central portion coaxial with the upper portion and lower portion and located between the upper portion and the lower portion; a first frustum shaped cavity formed in the upper portion of the body with the apex of the first frustum shaped cavity adjacent to the central portion, wherein the first frustum shaped cavity is coated with a first conducting material and is connectable to an antenna feed element; a second frustum shaped cavity formed in the lower portion of the body with the apex of the second frustum shaped cavity adjacent to the central portion, wherein the second frustum shaped cavity is coated with a second conducting material and is connectable to a ground element; a cavity formed in the central portion connecting the apex of the first frustum shaped cavity and the apex of the second frustum shaped cavity, the cylindrical cavity lacking a coating of conducting material and having a cross-sectional area sufficient to receive the antenna feed element; and a parasitic element encircling the central portion and comprising a band of a third conducting material, wherein the parasitic is separated from the coating of the first frustum shaped cavity and the coating of the second frustum shaped cavity by dielectric material of the dielectric body.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. The accompanying descriptive text may refer to such views as "top," "bottom" or "side" views, Similarly, the accompanying descriptive text may refer to various regions, or components, as "upper," "lower," middle," "center" components or regions. Such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a wideband antenna. In particular embodiments, the antenna is suitable for wideband communication across a wide spectrum. For example, a particular embodiment is suitable for use in the UWB spectrum's Band #3, centered at 3.96 GHz (see FIG. 1), and also suitable for use in the UWB spectrums Band Group #6 (see FIG. 1).

Figure 2B:
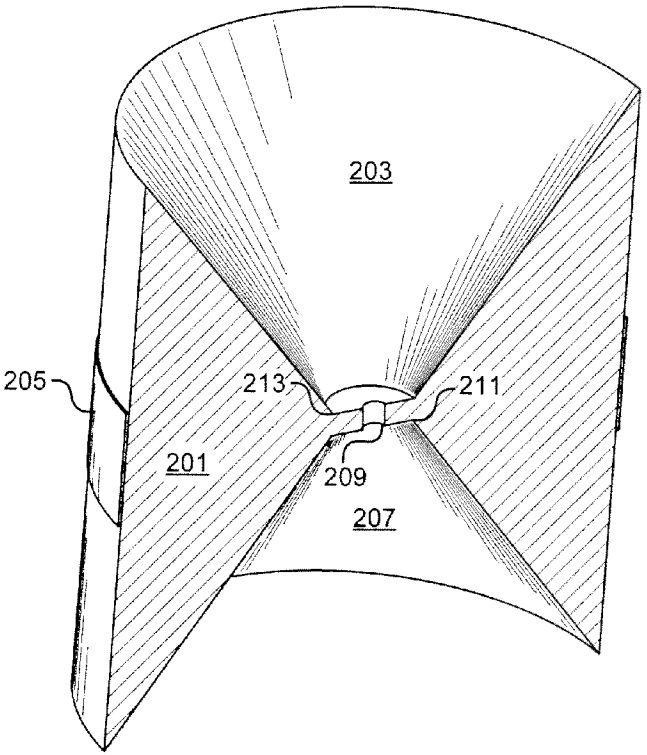
FIG. 2A illustrates an embodiment of the invention and FIG. 2B illustrates a cross-section of the embodiment.
Figure 2A:
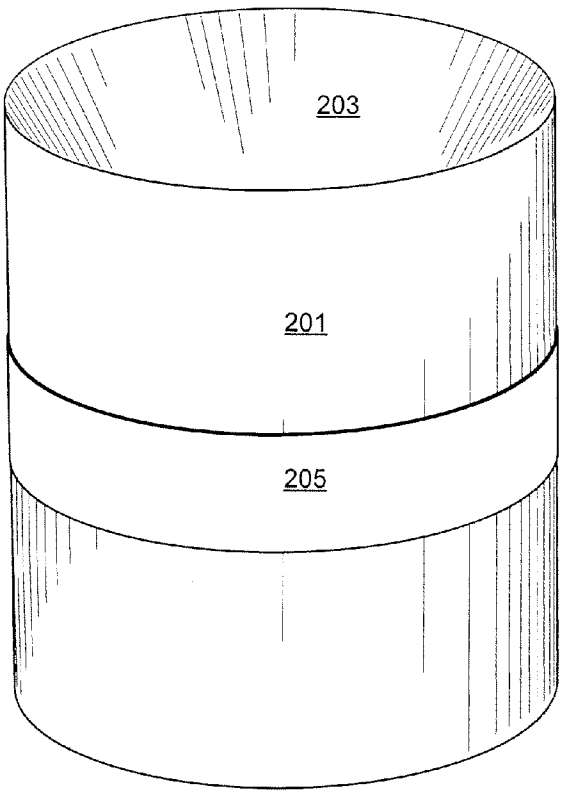

FIG. 2A illustrates an embodiment of the invention and FIG. 2B illustrates a cross-section of the embodiment. In the illustrated embodiment, the antenna comprises a body 201 of dielectric material. For example, the dielectric material may comprise polytetrafluoroethylene (PTFE), or any other microwave dielectric material such as nylon, polystyrene, polyethylene etc, or various microwave ceramics based material based materials. Two opposing frustum shaped cavities 203 and 207 are formed in the body 201. In the illustrated embodiment, the cavities 203 and 207 are conical frustums facing in opposite directions, with their apexes 213 and 211, respectively, adjacent to each other in a central region within the body 201.

The upper cavity 203, formed in an upper portion of the body 201, is coated with a first conducting material, such as copper, silver, gold, or other conductive materials, and is configured to be connected to an antenna feeding element. For example, the upper cavity 203 may be connectable to the center conductor of a coaxial cable (such as a 50 ohm cable). In a particular embodiment, the coating of conducting material at the apex 213 is sufficiently thick that the center conductor of a 50 ohm cable may be soldered to the antenna.

The lower cavity 207, formed in a lower portion of the body 201, is coated with a second conducting material, which may be the same material as the first conducting material coating of the upper cavity 203, such as copper, silver, or gold. The lower cavity 207 is configured to be connected to a grounding element. For example, if the upper cavity 203 is connected to the center conductor of a coaxial cable, the lower cavity 207 may be connected the coaxial cable's shielding.

A central cavity 209 is formed in a central portion of the body 201. The central cavity 209 connected the apex 213 of the upper cavity 203 with the apex 211 of the lower cavity to allow for connection of a feed structure. For example, the central cavity 209 may be dimensioned to allow passage of the central conductor of a coaxial cable. The central cavity 209 is not coated in any conductive material, so that the upper cavity 203 and the lower cavity 207 are separated from each other by dielectric material in the central portion of the body 201.

A parasitic element 205 is disposed to the feed region of the antenna by encircling the central cavity 209, apexes 213 and 211, and adjacent conductive regions where current is highest during operation. In the illustrated embodiment, the dielectric body is cylindrical, and the parasitic element 205 has a circular latitudinal cross section. In other embodiments, the shape of the latitudinal cross section of band 205 may vary. For example, the band 205 might have s square latitudinal cross section if the body 201 were a square prism. The parasitic element 205 is composed of a conductive material. In some embodiments, the conductive material may be the same conductive material coating the cavity 203 or 207, while in other embodiments, the conductive materials may be different. The band is separated from the conducting surfaces of cavities 203 and 207 by dielectric material of body 201, forming a parasitic element. This parasitic element 205 improves matching, gain flatness, and makes the antenna less susceptible to detuning when compared to an equivalent antenna lacking the parasitic element 205.

Figure 2C:
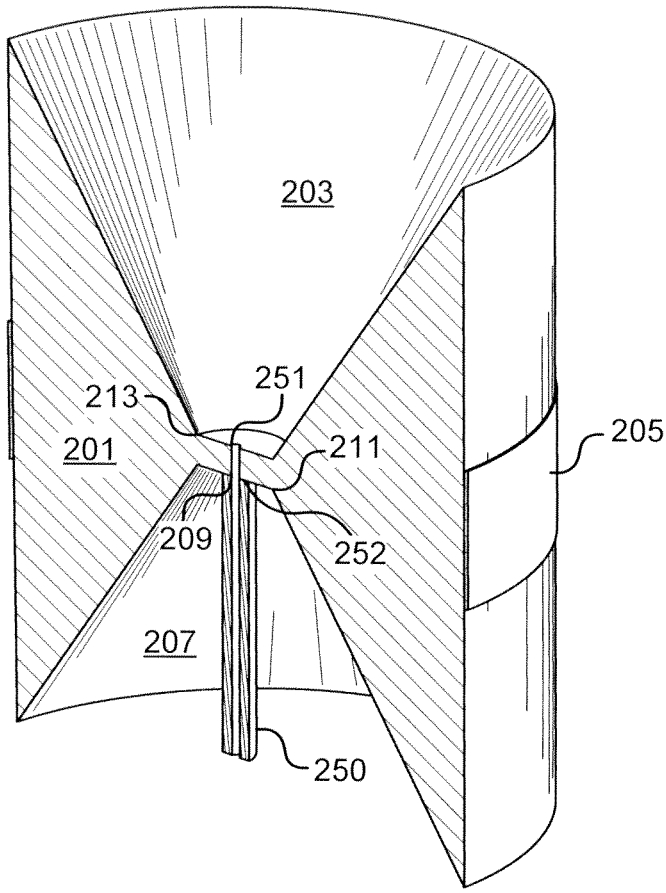
FIG. 2C illustrates the antenna embodiment of FIGS. 2A and 2B with a feed line connection.

FIG. 2C illustrates the antenna embodiment of FIGS. 2A and 2B with a feed line connection. In the illustrated embodiment, the antenna is fed with a coaxial cable 250. For example, the cable 250 may comprise a 50 ohm coax. The cable's 250 center conductor 251 passes through the central cavity 209 and is connected to the apex 213 of upper cavity 203. The cable's 250 shielding 252 is connected to the apex 211 of lower cavity 207. In the illustrated embodiment, the dimensions of the antenna are symmetrical about the central region. Accordingly, in this embodiment, either cavity 203 or 207 may serve as the upper cone receiving the center conductor 251 and the other cavity 207 or 203 may serve as the lower cone receiving the shield 252. In other embodiments, the cavities 203 and 207 may have differing dimensions such that each cone is configured to be coupled to only one of the center conductor 251 or the shield 252.

Figure 1:
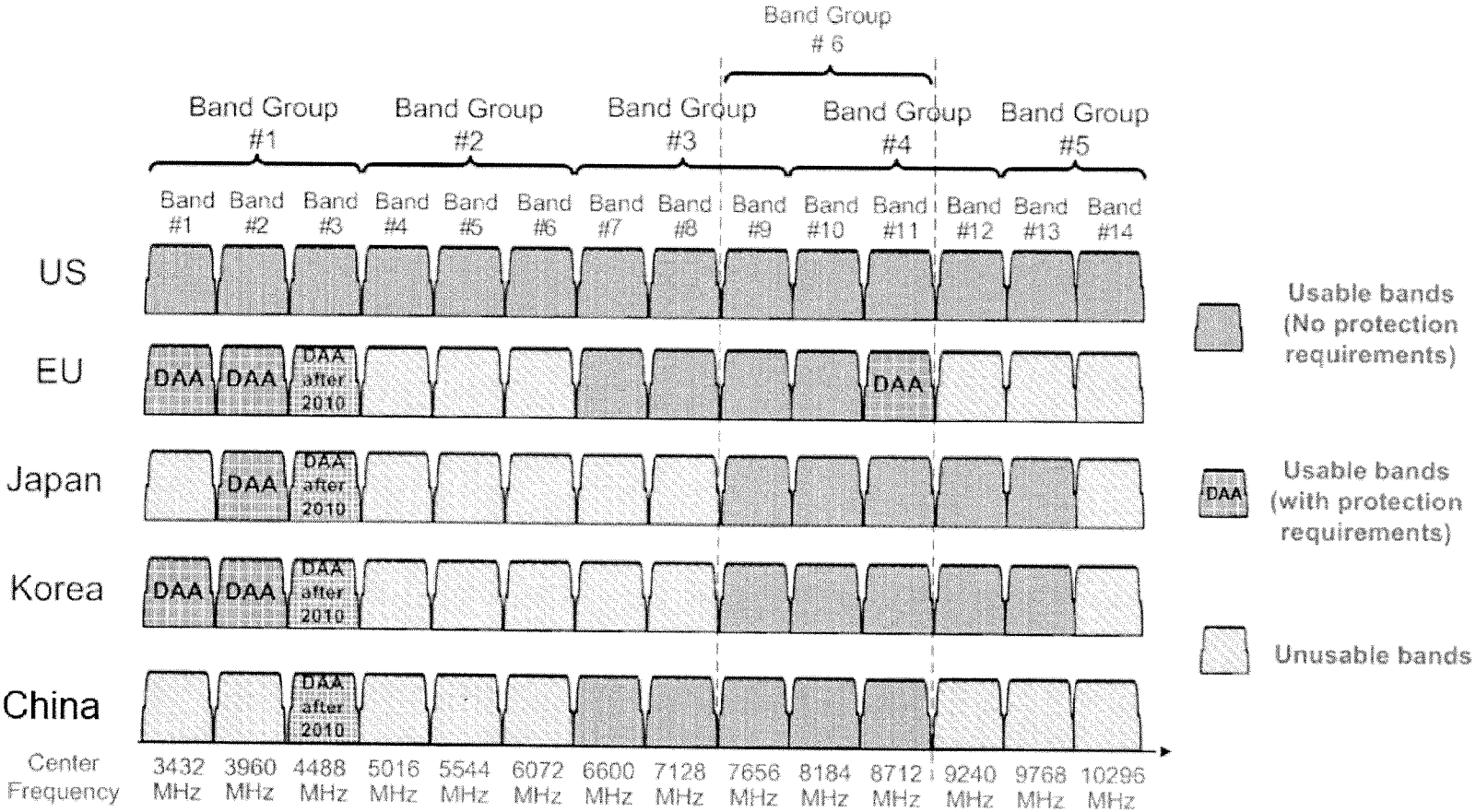
FIG. 1 illustrates the UWB spectrum and its regulatory status as of January, 2009.
Figure 3:
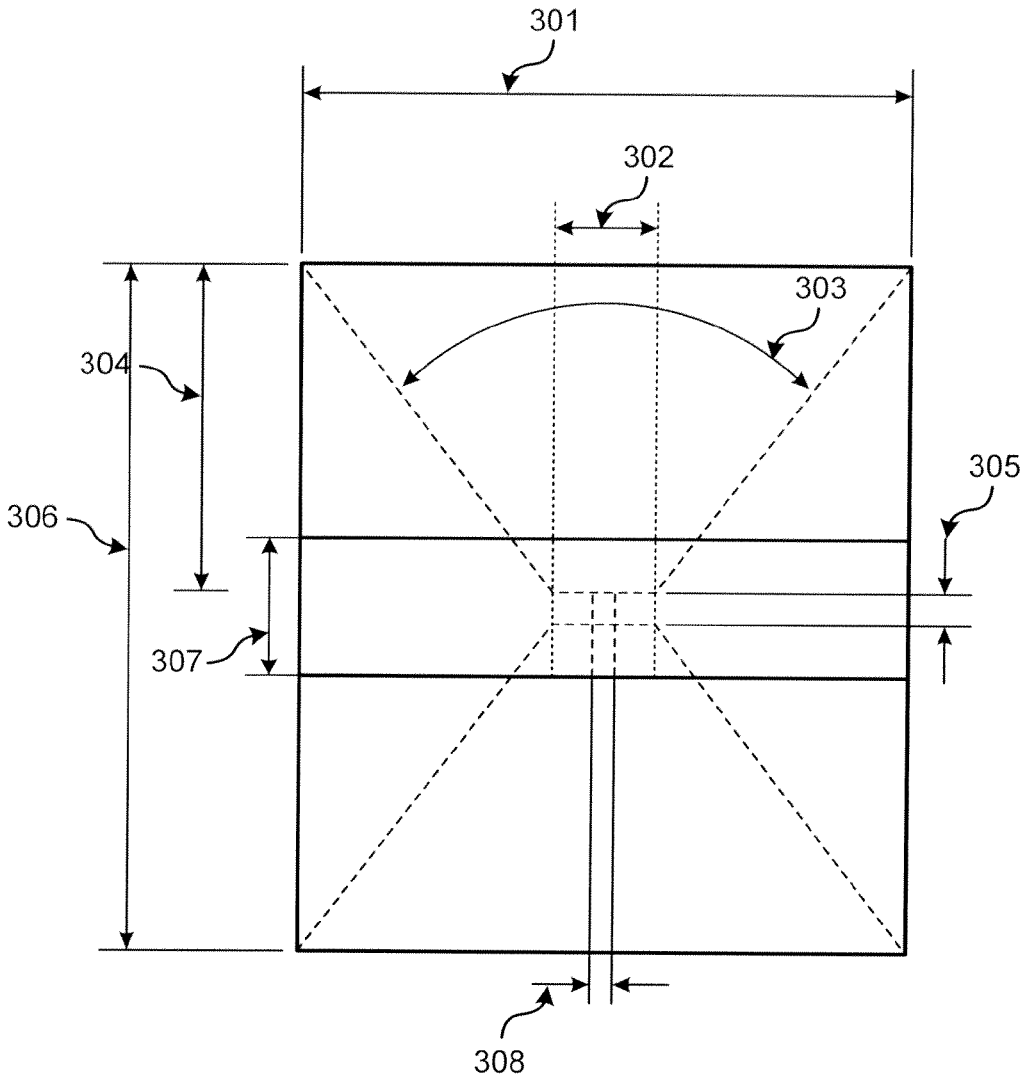
FIG. 3 illustrates dimensional parameters of a cylindrical bodied bicone antenna implemented in accordance with an embodiment of the invention.

FIG. 3 illustrates dimensional parameters of a cylindrical bodied bicone antenna implemented in accordance with an embodiment of the invention. In conjunction with this description, the specific dimensions of a particular embodiment suitable for wideband communications in the 3rd band and 6th band group of the UWB communication spectrum, as illustrated in FIG. 1, are described. In other embodiments, the antenna dimensions are configured according to the desired frequency band that the antenna will operate in. In particular, the lower operational frequency is determined by the specific dimensions of the antenna. The upper operational frequency is determined by implementation imperfections related to parasitic inductances or capacitances. The bicone antenna's characteristic impedance is approximately given by:

$$Zc=120\ 1n\ \mathrm{ctg}(\theta/2),$$

where θ is half the cone angle (for example, FIG. 3, no. 303). The exact linear dimensions of the antenna at the minimal operational frequency are functions of targeted gain and uniformity of the radiation pattern. When dimensions differ from the dimensions described herein, they may be found by EM solver optimization.

The illustrated antenna has a diameter 301, that defines the base diameters of both cavities and the width of the antenna body. In the particular embodiment, a diameter of about 20 mm may be employed. The apexes of the cavities have diameters 302. In the particular embodiment, the apexes may have a diameter of about 3.4 mm. The cavities have an angle 303 that, in the illustrated conical embodiment, defines the solid angle subtended by the cavities. In the described particular embodiment, the angle may be about 74°. The antenna body is divided into an upper portion having the upper cavity, a lower portion having the lower cavity, and a central portion having the central cavity. In the illustrated embodiment, the upper portion and the lower portion have an equal height 304. However, in other embodiments, the heights may be asymmetrical. In the described particular embodiment, each cavity has a height 304 of about 11 mm. The central portion has a height 305, for example, in the particular embodiment, the height may be about 1 mm. The central cavity has a diameter 308 sufficient to allow passage of a feeding conductor. For example, in the particular embodiment, the central cavity diameter 308 may be about 0.7 mm. The parasitic band encircles the feeding connection region of the antenna and has a height 307 sufficient to protect the feeding connection region from detuning. In the particular described embodiment, the band has a height of about 4.5 mm. The entire antenna body has a height 306. In the particular described embodiment, this height may be about 23 mm. The cavities and band are plated with copper, for example, a 2 oz weight plating of copper gives sufficient thickness for soldering.

Figure 4:
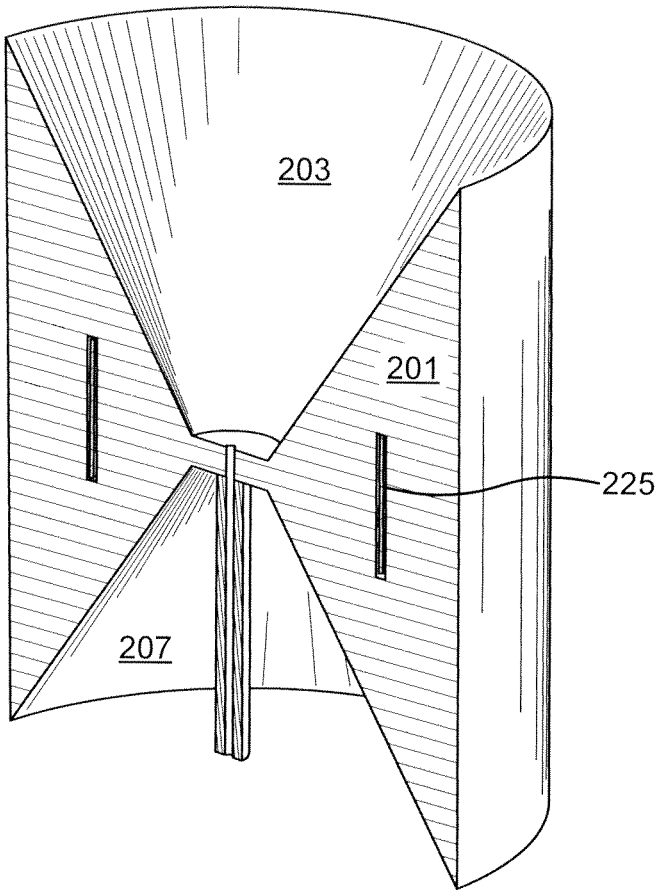
FIG. 4 illustrates an alternative embodiment of the invention.

FIG. 4 illustrates an alternative embodiment of the invention. In this embodiment the parasitic band 225 that protects the feed connection region has a diameter that is smaller than the maximum diameter of the cavities 203 and 207. As illustrated, this may be achieved by embedding the band in the dielectric material body 201, instead of plating the outer surface of the body as in FIG. 2. In other embodiments, the body itself may have a diameter that reduces in the central region proximal to the center cavity and feed connection regions. For example, the body may have an hour-glass shape, and the band may be plated on the narrow portion of the hour-glass body.

FIGS. 5A through 7B illustrate the results of simulations of antenna performance for an embodiment of the invention with the particular dimensional parameters described above with respect to FIG. 3 for the UWB antenna.

Figure 5A:
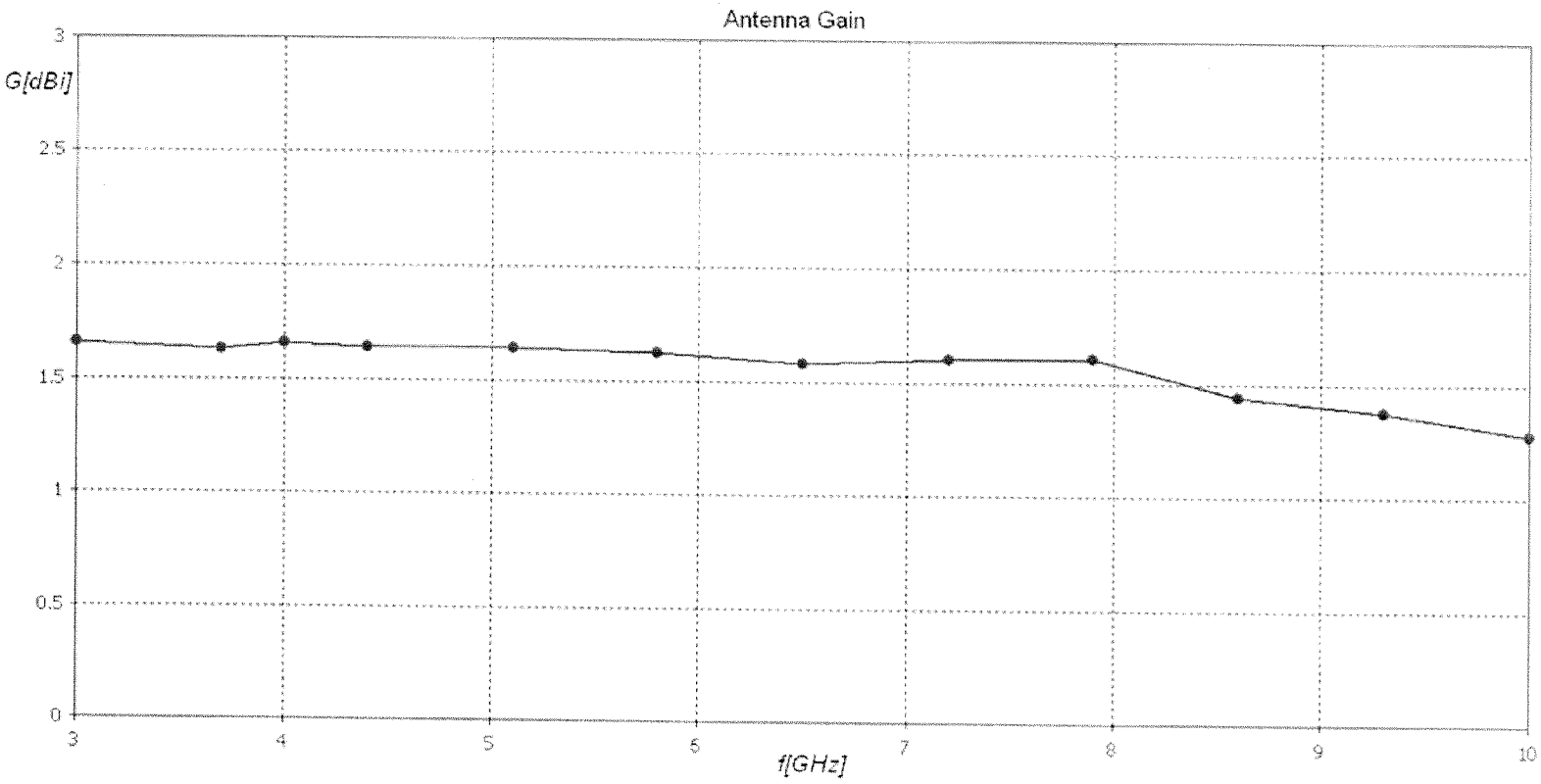
FIG. 5A illustrates antenna gain vs. frequency characteristics for the particular UWB antenna embodiment described with respect to FIG. 3.
Figure 5B:
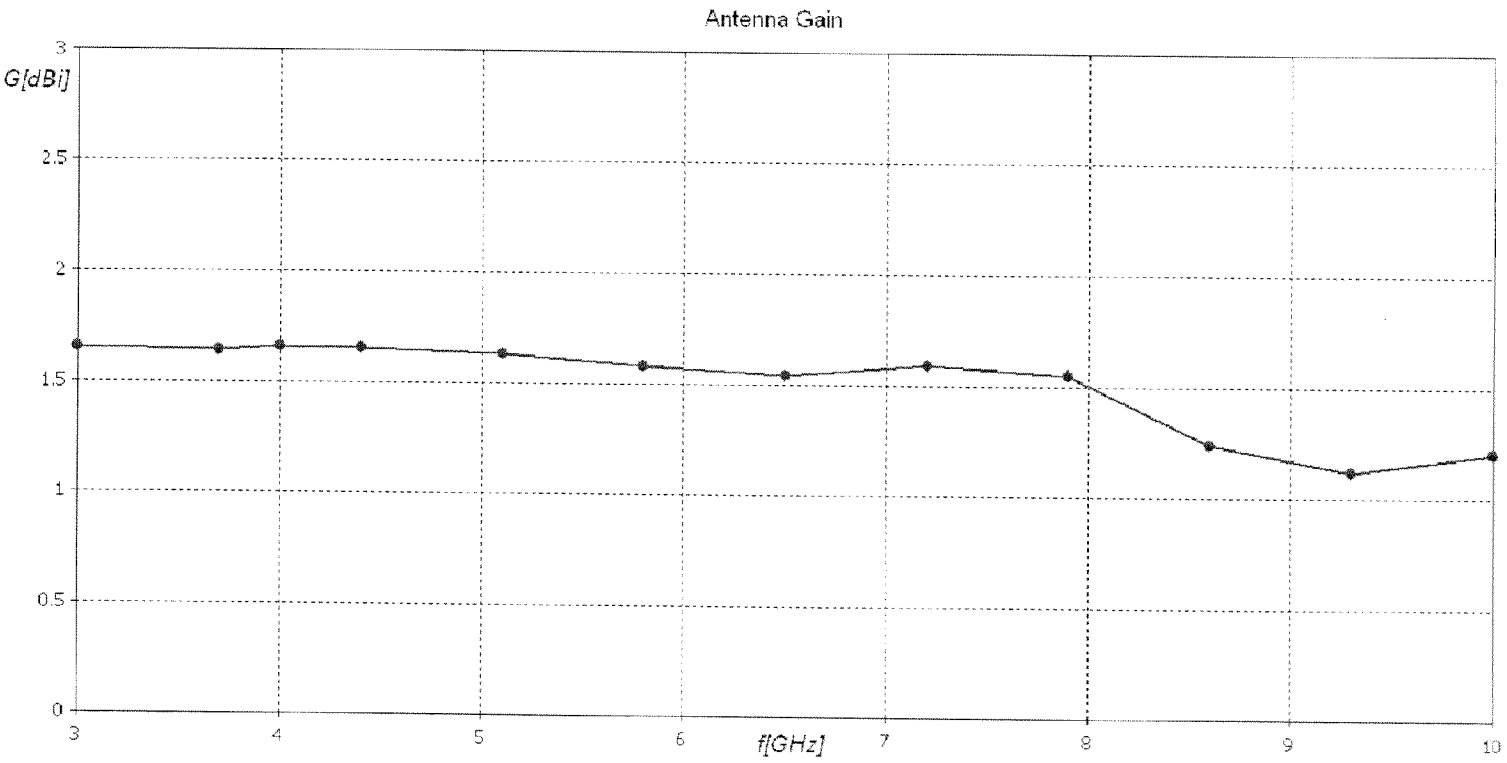
FIG. 5B illustrates antenna gain vs. frequency characteristics for an antenna having the same dimensions but without the parasitic belt.

FIG. 5A illustrates antenna gain vs. frequency characteristics for the particular UWB antenna embodiment described with respect to FIG. 3. FIG. 5B illustrates antenna gain vs. frequency characteristics for an antenna having the same dimensions but without the parasitic element 305. As the diagrams illustrate, the antenna gain distribution is 0.2 dB over the illustrated 6 GHz range, which makes the antenna suitable for operations in UWB band group 1 and band group 6 (see FIG. 1). Comparing FIG. 5A with 5B, the parasitic element 305 improves the high frequency antenna response, making the gain vs. frequency characteristic flatter.

Figure 6A:
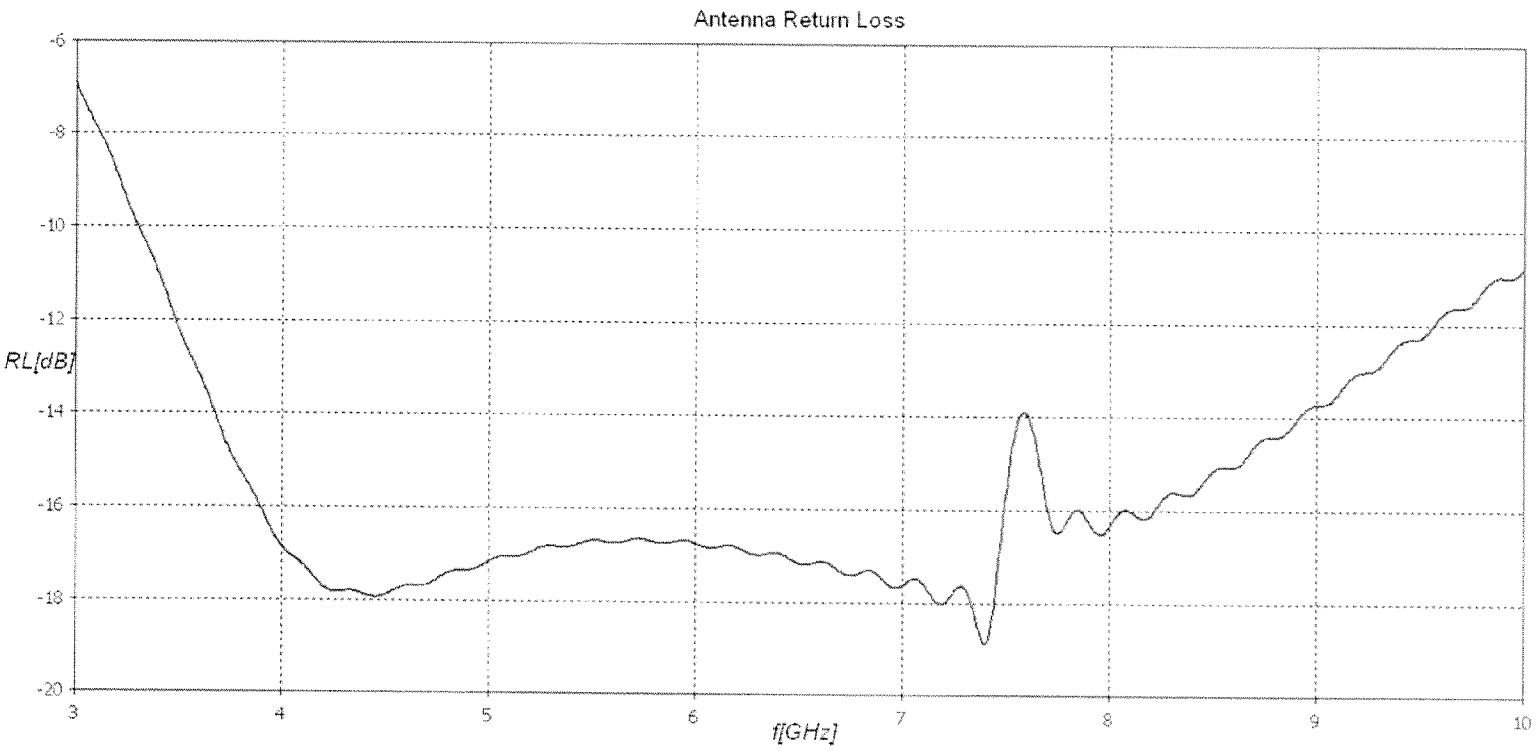
FIG. 6A illustrates the antenna return loss diagram for the particular UWB antenna embodiment described with respect to FIG. 3.
Figure 6B:
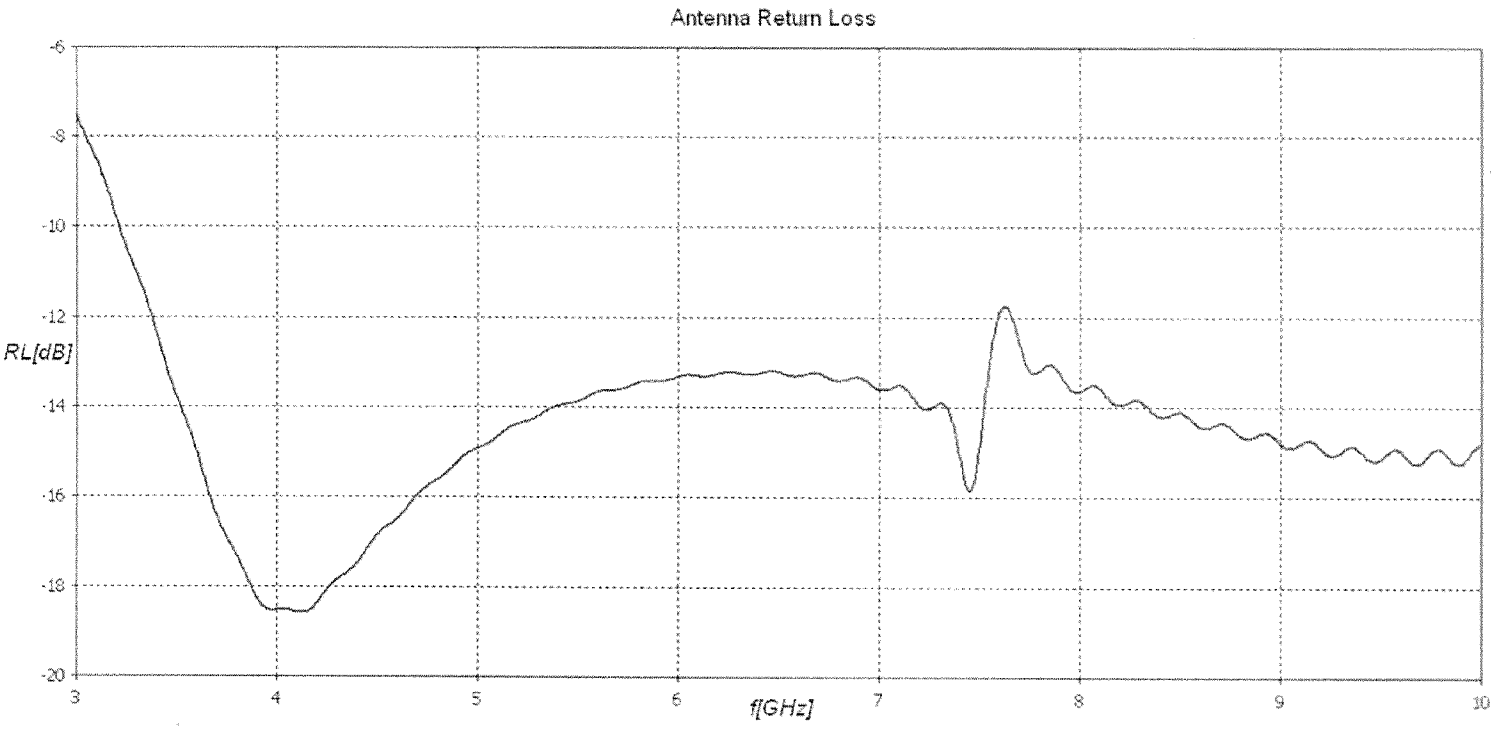
FIG. 6B illustrates the return loss for an equivalent antenna lacking the parasitic belt.

FIG. 6A illustrates the antenna return loss diagram for the particular UWB antenna embodiment described with respect to FIG. 3. FIG. 6B illustrates the return loss for an equivalent antenna lacking the parasitic belt. As illustrated, antenna return loss remains very good within entire UWB spectrum. In particular, in Band #3, (see, FIG. 1) band return loss is better then −16 dB, while in the entire band group 6, it remains below −14 dB. As illustrated in FIG. 5B, absence of the parasitic element makes matching performances more uneven across the bands of interest.

Figure 7A:
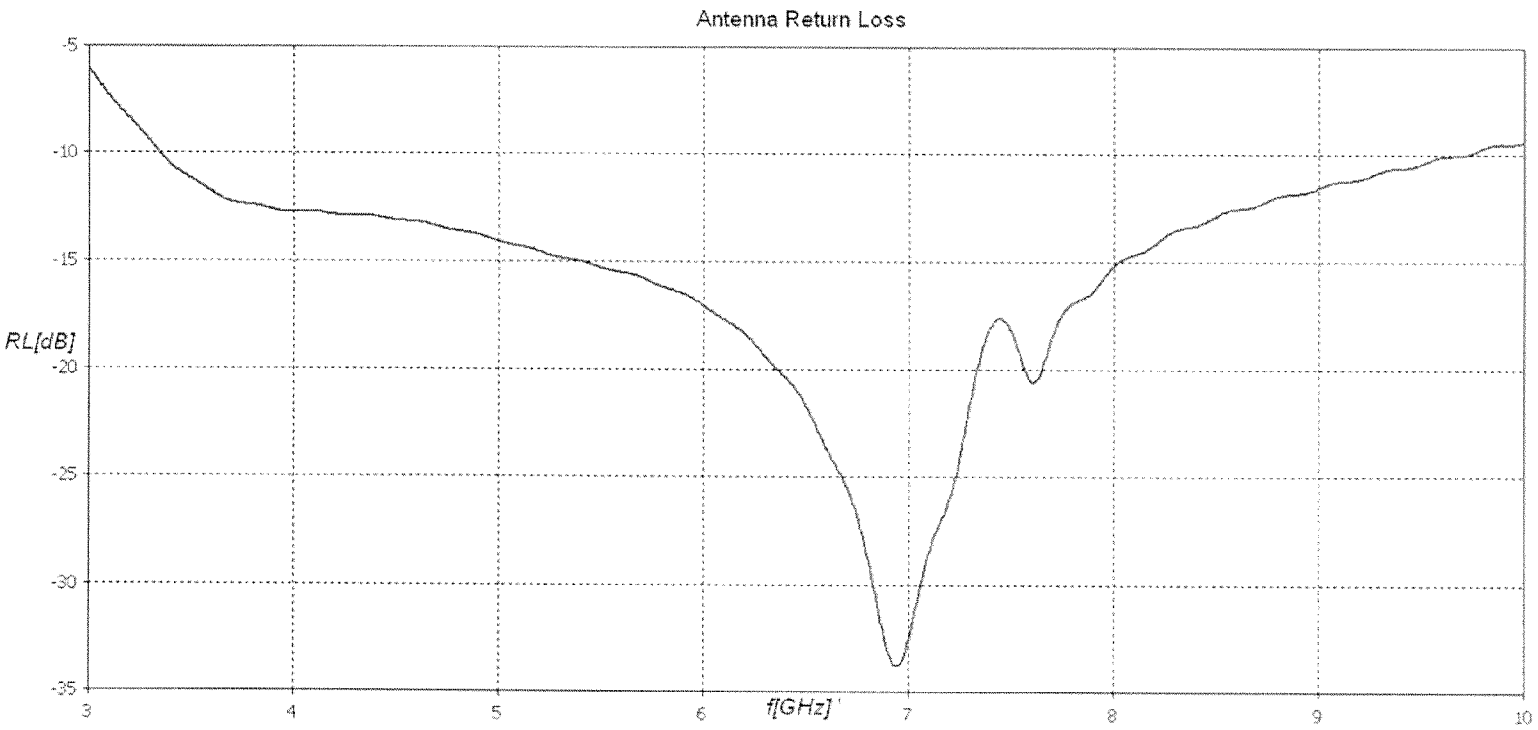
FIG. 7A illustrates the antenna return loss for the particular UWB antenna embodiment described in FIG. 3 when in the presence of an interfering object, specifically organic tissue.
Figure 7B:
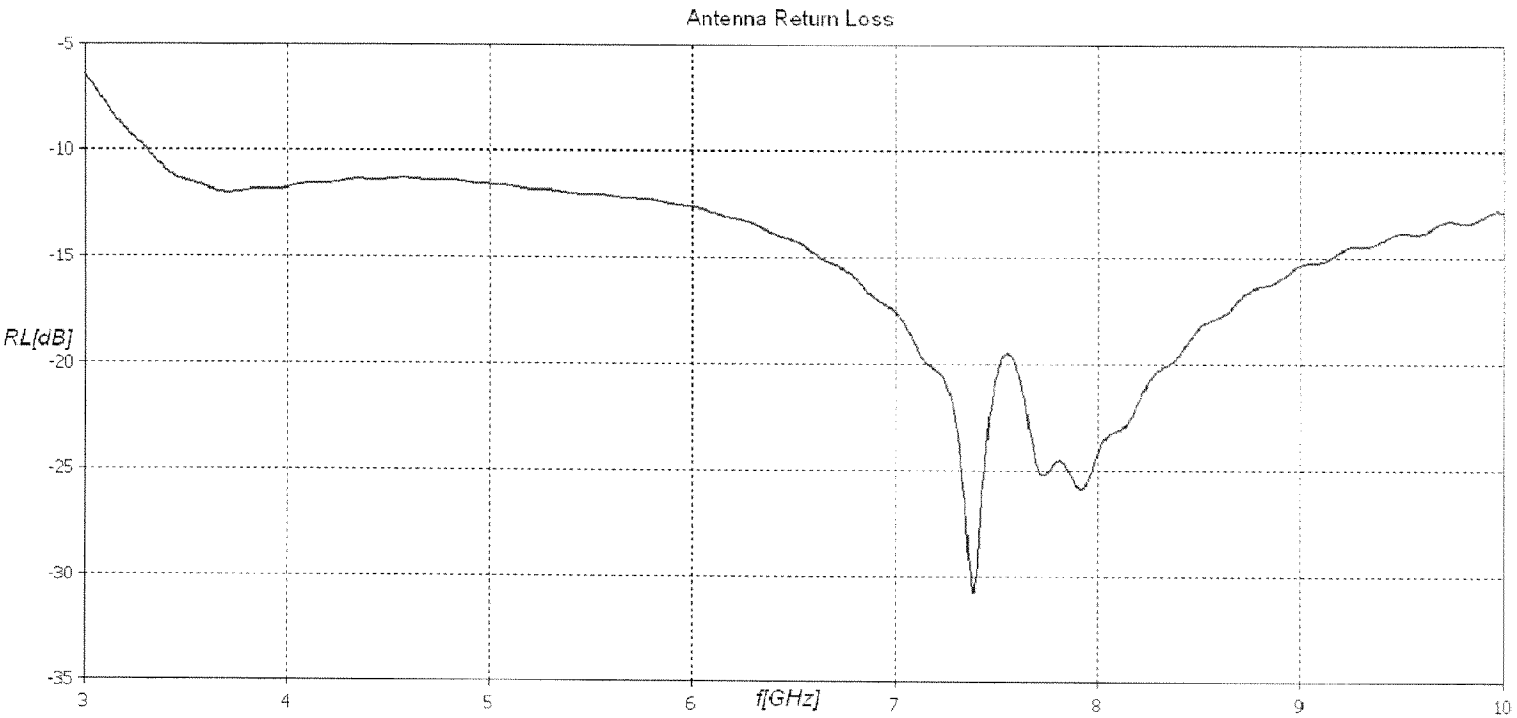
FIG. 7B illustrates the antenna return loss for an equivalent antenna lacking the parasitic element when in the presence of the same interfering object.

FIG. 7A illustrates the antenna return loss for the particular UWB antenna embodiment described in FIG. 3 when in the presence of an interfering object, specifically organic tissue. FIG. 7B illustrates the antenna return loss for an equivalent antenna lacking the parasitic element when in the presence of the same interfering object. As illustrated, the embodiment of the antenna with the parasitic element exhibits less detuning in the lower frequency range than the one without the parasitic element.

Figure 8:
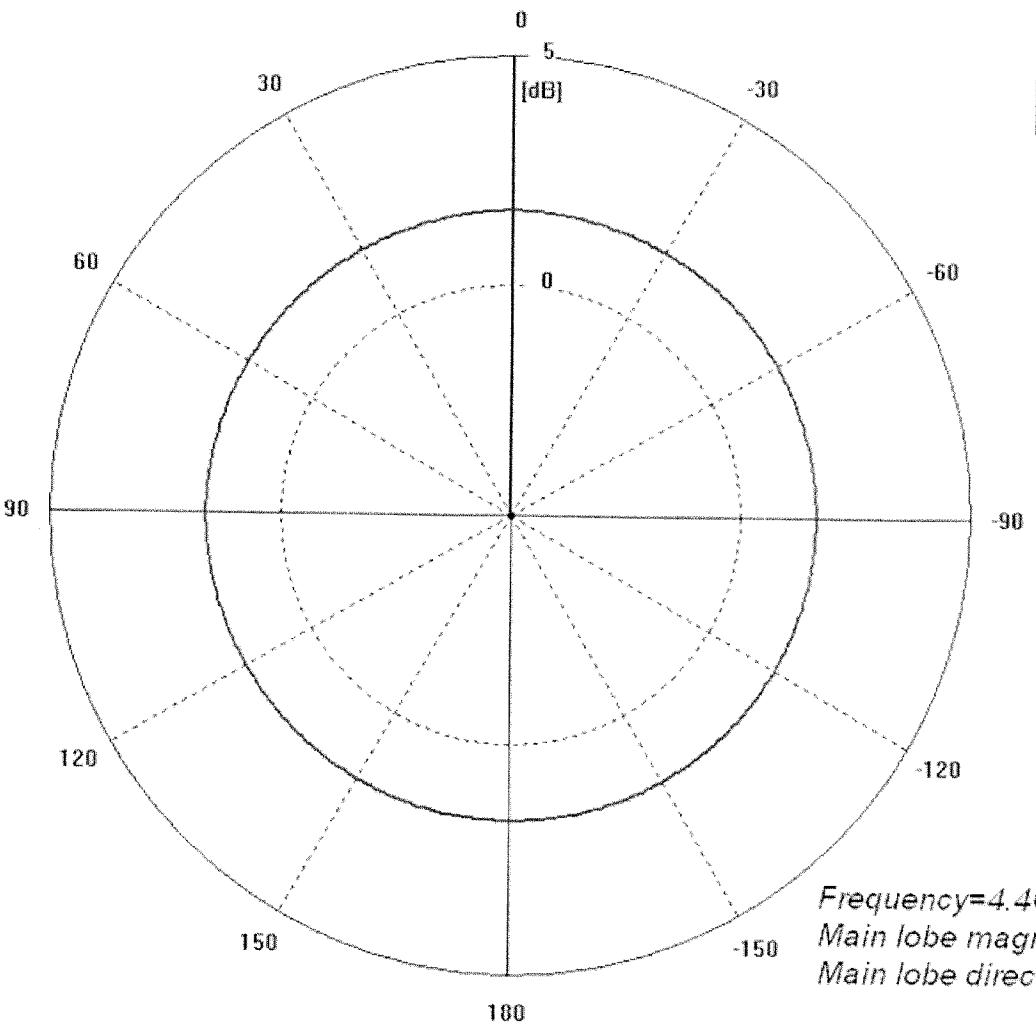
FIG. 8 illustrates a simulation of the far field radiation pattern of the UWB embodiment described with respect to FIG. 3.

FIG. 8 illustrates a simulation of the far field radiation pattern of the UWB embodiment described with respect to FIG. 3. As illustrated, the antenna exhibits a perfectly symmetrical radiation pattern, with a gain of 1.6 dB at 4.4 GHZ. The antenna radiation pattern (not shown) is uniformly distributed as well. Further, when in the presence of an interfering object, the antenna further shows an increased directivity on the opposing side of the antenna, and thus increased antenna gain in the direction away from the interfering object.

Various embodiments of the invention may be implemented in electronic devices used to for wireless communications. One such example device is the computing module shown in FIG. 9. Various embodiments are described in terms of this example—computing module 400. After reading this description, it will become apparent to a person skilled in the relevant art how to implement the invention using other computing modules or architectures.

As used herein, the term module might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Figure 9:
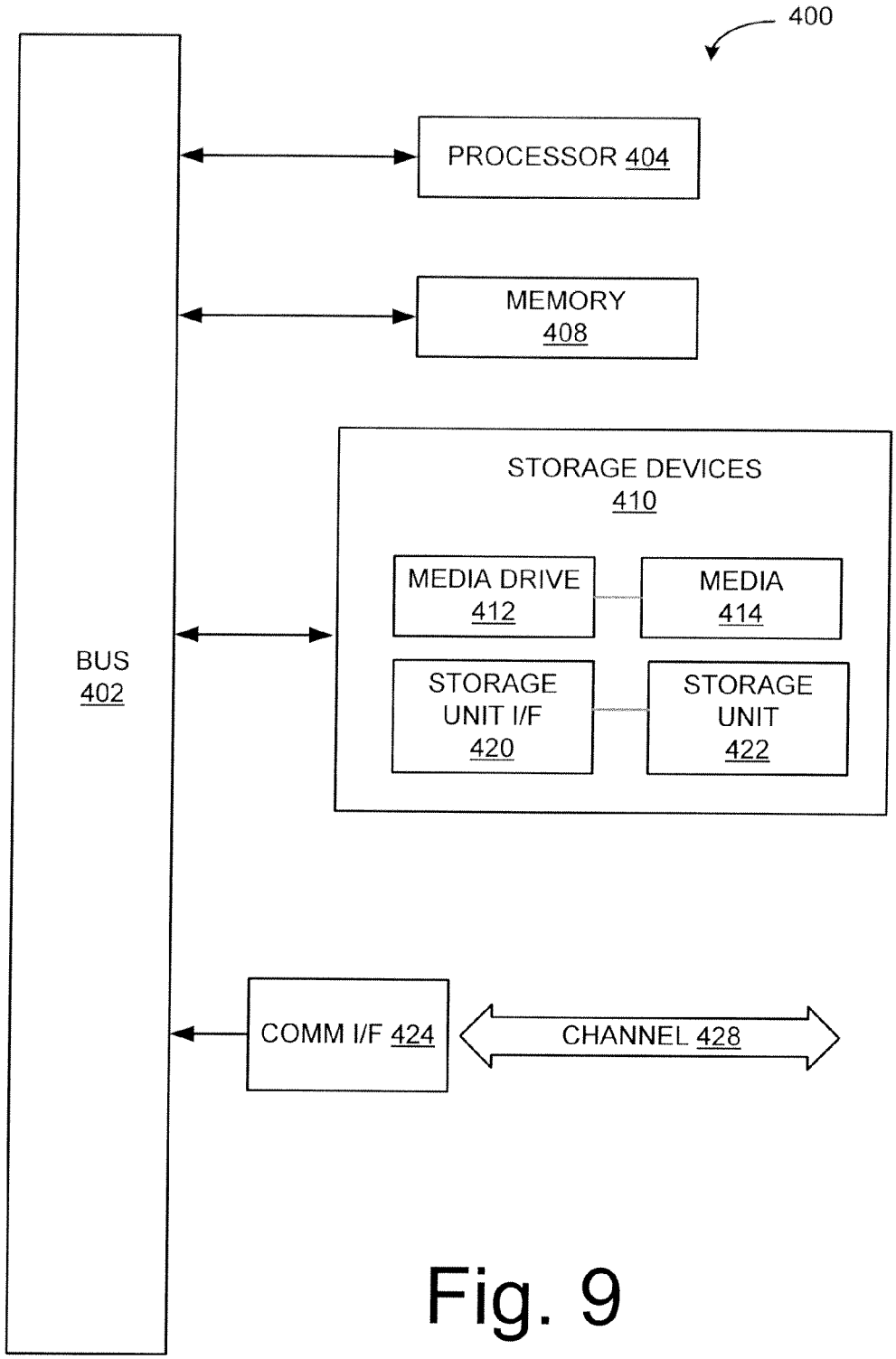
FIG. 9 illustrates an example electronic device in which embodiments of the invention may be used.

Referring now to FIG. 9, computing module 400 may represent, for example, computing or processing capabilities found within desktop, laptop and notebook computers; handheld computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 400 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 400 might include, for example, one or more processors, controllers, control modules, or other processing devices, such as a processor 404. Processor 404 might be implemented using a general-purpose or special-purpose processing engine such as, for example, a microprocessor, controller, or other control logic. In the illustrated example, processor 404 is connected to a bus 402, although any communication medium can be used to facilitate interaction with other components of computing module 400 or to communicate externally.

Computing module 400 might also include one or more memory modules, simply referred to herein as main memory 408. For example, preferably random access memory (RAM) or other dynamic memory, might be used for storing information and instructions to be executed by processor 404. Main memory 408 might also be used for storing temporary variables or other intermediate information during execution of instructions to be executed by processor 404. Computing module 400 might likewise include a read only memory ("ROM") or other static storage device coupled to bus 402 for storing static information and instructions for processor 404.

The computing module 400 might also include one or more various forms of information storage mechanism 410, which might include, for example, a media drive 412 and a storage unit interface 420. The media drive 412 might include a drive or other mechanism to support fixed or removable storage media 414. For example, a hard disk drive, a floppy disk drive, a magnetic tape drive, an optical disk drive, a CD or DVD drive (R or RW), or other removable or fixed media drive might be provided. Accordingly, storage media 414 might include, for example, a hard disk, a floppy disk, magnetic tape, cartridge, optical disk, a CD or DVD, or other fixed or removable medium that is read by, written to or accessed by media drive 412. As these examples illustrate, the storage media 414 can include a computer usable storage medium having stored therein computer software or data.

In alternative embodiments, information storage mechanism 410 might include other similar instrumentalities for allowing computer programs or other instructions or data to be loaded into computing module 400. Such instrumentalities might include, for example, a fixed or removable storage unit 422 and an interface 420. Examples of such storage units 422 and interfaces 420 can include a program cartridge and cartridge interface, a removable memory (for example, a flash memory or other removable memory module) and memory slot, a PCMCIA slot and card, and other fixed or removable storage units 422 and interfaces 420 that allow software and data to be transferred from the storage unit 422 to computing module 400.

Computing module 400 further includes a communications interface 424. Communications interface 424 comprises an antenna implemented in accordance with an embodiment of invention and might be used to allow software and data to be transferred between computing module 400 and external devices. Communication interface 424, may further comprise other components, such as wired interfaces, and may comprise a plurality of antennas, for example to implement an antenna array. Examples of communications interface 424 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 424 might typically be carried on signals, which can be electronic, electromagnetic (which includes optical) or other signals capable of being exchanged by a given communications interface 424. These signals might be provided to communications interface 424 via a channel 428. This channel 428 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 408, storage unit 420, media 414, and channel 428. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 400 to perform features or functions of the present invention as discussed herein.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented a being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A bicone antenna, comprising:

a dielectric body having an upper portion, a lower portion, and a central portion coaxial with the upper portion and lower portion and located between the upper portion and the lower portion;

a first frustum shaped cavity formed in the upper portion of the body with the apex of the first frustum shaped cavity adjacent to the central portion, wherein the first frustum shaped cavity is coated with a first conducting material and is connectable to an antenna feed element;

a second frustum shaped cavity formed in the lower portion of the body with the apex of the second frustum shaped cavity adjacent to the central portion, wherein the second frustum shaped cavity is coated with a second conducting material and is connectable to a ground element;

a cylindrical cavity formed in the central portion, the cylindrical cavity connecting the apex of the first frustum shaped cavity and the apex of the second frustum shaped cavity, the cylindrical cavity lacking a coating of conducting material and having a cross-sectional area sufficient to receive the antenna feed element; and a parasitic element encircling the central portion and comprising a band of a third conducting material, wherein the parasitic is separated from the coating of the first frustum shaped cavity and the coating of the second frustum shaped cavity by dielectric material of the dielectric body.

2. The bicone antenna of claim 1, wherein the first frustum shaped cavity has approximately the same dimensions as the second frustum shaped cavity.

3. The bicone antenna of claim 1, wherein the first frustum shaped cavity and the second frustum shaped cavity are conical frustum shaped cavities.

4. The bicone antenna of claim 1, wherein the dielectric body is cylindrical.

5. The bicone antenna of claim 1, wherein the dielectric body comprises polytetrafluoroethylene.

6. The bicone antenna of claim 1, wherein the first, second, and third conducting materials comprise copper.

7. An electrical device, comprising:

a radio subsystem;

a processor coupled to the radio subsystem; and a bicone antenna coupled to the radio subsystem, the bicone antenna comprising:

a dielectric body having an upper portion, a lower portion, and a central portion coaxial with the upper portion and lower portion and located between the upper portion and the lower portion;

a first frustum shaped cavity formed in the upper portion of the body with the apex of the first frustum shaped cavity adjacent to the central portion, wherein the first frustum shaped cavity is coated with a first conducting material and is connectable to an antenna feed element;

a second frustum shaped cavity formed in the lower portion of the body with the apex of the second frustum shaped cavity adjacent to the central portion, wherein the second frustum shaped cavity is coated with a second conducting material and is connectable to a ground element;

a cylindrical cavity formed in the central portion, the cylindrical cavity connecting the apex of the first frustum shaped cavity and the apex of the second frustum shaped cavity, the cylindrical cavity lacking a coating of conducting material and having a cross-sectional area sufficient to receive the antenna feed element; and a parasitic element encircling the central portion and comprising a band of a third conducting material, wherein the parasitic is separated from the coating of the first frustum shaped cavity and the coating of the second frustum shaped cavity by dielectric material of the dielectric body.

8. The electrical device of claim 7, wherein the first frustum shaped cavity has approximately the same dimensions as the second frustum shaped cavity.

9. The electrical device of claim 7, wherein the first frustum shaped cavity and the second frustum shaped cavity are conical frustum shaped cavities.

10. The electrical device of claim 7, wherein the dielectric body is cylindrical.

11. The electrical device of claim 7, wherein the dielectric body comprises polytetrafluoroethylene.

12. The electrical device of claim 7, wherein the first, second, and third conducting materials comprise copper.

13. A method of signal reception or transmission, comprising:

transmitting or receiving a signal using a bicone antenna, the bicone antenna comprising:

a dielectric body having an upper portion, a lower portion, and a central portion coaxial with the upper portion and lower portion and located between the upper portion and the lower portion;

a first frustum shaped cavity formed in the upper portion of the body with the apex of the first frustum shaped cavity adjacent to the central portion, wherein the first frustum shaped cavity is coated with a first conducting material and is connectable to an antenna feed element;

a second frustum shaped cavity formed in the lower portion of the body with the apex of the second frustum shaped cavity adjacent to the central portion, wherein the second frustum shaped cavity is coated with a second conducting material and is connectable to a ground element;

a cylindrical cavity formed in the central portion, the cylindrical cavity connecting the apex of the first frustum shaped cavity and the apex of the second frustum shaped cavity, the cylindrical cavity lacking a coating of conducting material and having a cross-sectional area sufficient to receive the antenna feed element; and a parasitic element encircling the central portion and comprising a band of a third conducting material, wherein the parasitic is separated from the coating of the first frustum shaped cavity and the coating of the second frustum shaped cavity by dielectric material of the dielectric body.

14. The method of claim 13, wherein the first frustum shaped cavity has approximately the same dimensions as the second frustum shaped cavity.

15. The method of claim 13, wherein the first frustum shaped cavity and the second frustum shaped cavity are conical frustum shaped cavities.

16. The method of claim 13, wherein the dielectric body is cylindrical.

17. The method of claim 13, wherein the dielectric body comprises polytetrafluoroethylene.

18. The method of claim 13, wherein the first, second, and third conducting materials comprise copper.

* * * * *